US007886837B1

(12) United States Patent
Helfgott

(10) Patent No.: US 7,886,837 B1
(45) Date of Patent: Feb. 15, 2011

(54) ROOF-MOUNTED FIRE SUPPRESSION SYSTEM

(76) Inventor: Hans E. W. Helfgott, 2406 Cedar Springs Dr., Elgin, SC (US) 29045

( * ) Notice: Subject to any disclaimer, the term of this patent is extended or adjusted under 35 U.S.C. 154(b) by 394 days.

(21) Appl. No.: 11/986,885

(22) Filed: Nov. 27, 2007

Related U.S. Application Data

(60) Provisional application No. 60/860,922, filed on Nov. 27, 2006.

(51) Int. Cl.
*A62C 3/00* (2006.01)

(52) U.S. Cl. ..... 169/54; 169/5; 169/60; 169/61; 239/267; 239/273; 239/280

(58) Field of Classification Search ..... 169/54, 169/5, 30, 67, 51, 208, 200, 209, 16, 60, 169/61, 45; 239/14.1, 14.2, 273, 275, 280, 239/267
See application file for complete search history.

(56) References Cited

U.S. PATENT DOCUMENTS

| | | | | | |
|---|---|---|---|---|---|
| 1,620,142 | A | | 3/1927 | Thompson | |
| 1,644,603 | A | * | 10/1927 | O'Neill | 169/16 |
| 2,865,674 | A | | 12/1958 | Jelmeland | |
| 3,179,181 | A | * | 4/1965 | Banzato | 169/13 |
| 3,583,490 | A | * | 6/1971 | McFadden | 169/60 |
| 4,019,581 | A | * | 4/1977 | Diggs | 169/16 |
| 4,091,876 | A | * | 5/1978 | Valdatta | 169/62 |
| 4,175,703 | A | * | 11/1979 | Valiant | 239/208 |
| 4,330,040 | A | * | 5/1982 | Ence et al. | 169/13 |
| 4,428,434 | A | * | 1/1984 | Gelaude | 169/13 |
| 4,453,155 | A | * | 6/1984 | Cooper | 340/289 |
| 5,054,254 | A | * | 10/1991 | Sells | 52/199 |
| 5,125,458 | A | * | 6/1992 | Berman | 169/16 |
| 5,165,482 | A | * | 11/1992 | Smagac et al. | 169/45 |
| 5,263,543 | A | * | 11/1993 | Nigro | 169/56 |
| 5,732,511 | A | * | 3/1998 | Scott | 52/1 |
| 6,109,361 | A | * | 8/2000 | Henderson | 169/54 |
| 6,167,971 | B1 | * | 1/2001 | Van Lingen | 169/16 |
| 6,282,858 | B1 | * | 9/2001 | Swick | 52/533 |
| 6,360,968 | B1 | * | 3/2002 | Orrange et al. | 239/273 |
| 6,447,390 | B1 | * | 9/2002 | O'Hagin | 454/250 |
| 6,450,264 | B1 | * | 9/2002 | Christian | 169/16 |
| 6,523,616 | B1 | | 2/2003 | Wallace | |
| 6,629,569 | B1 | | 10/2003 | Adams | |
| 6,945,468 | B1 | * | 9/2005 | Rodriguez et al. | 239/17 |
| 6,964,379 | B2 | | 11/2005 | Crowley | |
| D524,407 | S | * | 7/2006 | Crowley | D23/214 |

* cited by examiner

*Primary Examiner*—Len Tran
*Assistant Examiner*—Trevor E McGraw
(74) *Attorney, Agent, or Firm*—Montgomery Patent and Design; Robert C. Montgomery

(57) ABSTRACT

An external sprinkler system for use on homes is herein disclosed. It is designed to prevent the ignition of the roof structure from glowing ashes or embers from a nearby wild fire or structure fire. The sprinkler system would use a series of nozzles connected to a common manifold and integrated therein a building structure's roof vents. The piping connecting the manifold is connected to a water supply via a control valve mounted at grade level. Control equipment provides switching between a public water supply and home cisterns. Runoff water is captured by the existing gutter system and recycled through the system. During activation, the system soaks the roof and house and makes it very difficult for ignition from an external source to take place. The system provides manual activation and remote activation from a cell phone or fire station.

4 Claims, 7 Drawing Sheets

ROOF-MOUNTED FIRE SUPPRESSION SYSTEM

RELATED APPLICATIONS

The present invention was first described in and claims the benefit of U.S. Provisional Patent Application No. 60/860,922 filed on Nov. 27, 2006, the entire disclosures of which are incorporated herein by reference.

FIELD OF THE INVENTION

The present invention relates generally to a residential fire suppression system and, more particularly, to said system installed within the roof system of a house drawing water from cisterns.

BACKGROUND OF THE INVENTION

Many areas are now plagued with wildfires. Even in areas where wildfires are not prevalent, adjacent structures may catch fire creating a risk of fire to the exposed structure. In these situations, many homeowners resort to using a garden hose to cool and prevent their home from being destroyed. This exposes the homeowner to serious death or injury and places the structure at the mercy of water supply availability. Accordingly, there exists a need for a means by which houses, buildings and other structures can be protected from falling embers from nearby forest fires, wildfires, or even nearby structure fires in an automatic and simple manner. The development of the invention herein described fulfills this need.

U.S. Pat. No. 6,964,379 issued to Crowley discloses an exterior fire suppression system and method of installation. This patent does not appear to disclose an apparatus that is capable of control via an RF signal nor does it appear to possess a conduit system with dispersal nozzles and a cistern supply.

U.S. Pat. No. 6,629,569 issued to Adams discloses a pop up roof sprinkler system. This patent does not appear to disclose an apparatus that possesses a manifold conduit mounted on a roof ridge vent with a plurality of dispersal nozzles for fire suppression nor does it appear to possess an alternate water supply source.

U.S. Pat. No. 6,523,616 issued to Wallace discloses a building fire extinguishing system. This patent does not appear to disclose an apparatus that is capable of switching water supply sources nor does it appear to disclose an apparatus that is capable of control via an RF signal.

U.S. Pat. No. 6,450,264 issued to Christian discloses a sprinkler system. This patent does not appear to disclose an apparatus that has a manifold incorporated into a roof ridge vent, nor does it appear to disclose an apparatus capable of RF activated switching between water supply sources.

U.S. Pat. No. 6,167,971 issued to Van Lingen discloses a fire protection system. This patent does not appear to disclose an apparatus that has a manifold incorporated into a roof ridge vent with lateral conduits and dispersing nozzles, nor does it appear to disclose an apparatus capable of RF activated switching between water supply sources.

U.S. Pat. No. 5,732,511 issued to Scott discloses a roof mounted fire protection system. This patent does not appear to disclose an apparatus that has a manifold incorporated into a roof ridge vent with lateral conduits and dispersing nozzles, nor does it appear to disclose an apparatus capable of RF activated switching between water supply sources.

U.S. Pat. No. 4,428,434 issued to Gelaude discloses an automatic fire protection system. This patent does not appear to disclose an apparatus that has a manifold incorporated into a roof ridge vent with lateral conduits and dispersing nozzles, nor does it appear to disclose an apparatus capable of RF activated switching between water supply sources.

U.S. Pat. No. 3,583,490 issued to McFadden discloses a fire protection system. This patent does not appear to disclose an apparatus that has a manifold incorporated into a roof ridge vent with lateral conduits and dispersing nozzles, nor does it appear to disclose an apparatus capable of RF activated switching between water supply sources.

U.S. Pat. No. 2,865,674 issued to Jemeland discloses a combination sprinkling and fire extinguishing apparatus and guttering. This patent does not appear to disclose an apparatus that is a roof mounted fire suppression apparatus nor does it disclose an apparatus capable of RF control.

U.S. Pat. No. 1,620,142 issued to Thompson discloses a fire extinguisher for structures. This patent does not appear to disclose an apparatus that has a manifold incorporated into a roof ridge vent with lateral conduits and dispersing nozzles, nor does it appear to disclose an apparatus capable of RF activated switching between water supply sources.

SUMMARY OF THE INVENTION

In view of the foregoing disadvantages inherent in the prior art, it has been observed that there is need for a roof-mounted fire suppression apparatus that provides a means for an external sprinkler system on a structure to prevent the ignition of the roof from flying ash or embers from a nearby ignition source.

The roof-mounted fire suppression apparatus provides a convenient means to provide an external sprinkler system for the roof of a structure.

The roof-mounted fire suppression apparatus when activated distributes water or other fire suppressant material on the surface of the roof structure to prevent or inhibit ignition.

The roof-mounted fire suppression apparatus comprises a roof-mounted water dispersal assembly, a control apparatus, supply piping, a pump and a cistern system.

The roof-mounted fire suppression apparatus roof-mounted water dispersal apparatus comprises a ridge vent, roof manifold conduit and a plurality of lateral conduits with a plurality of dispersal nozzles.

The roof-mounted fire suppression apparatus control apparatus comprises a RF receiver and antenna, a control module, a flow indicator transmitter, a power switch, interconnected wiring and a valve.

The roof-mounted fire suppression apparatus can utilize as its water source any water supply source such as, but not limited to: the public water main line and/or cisterns.

The roof-mounted fire suppression apparatus is capable of remotely switching water supply sources.

The roof-mounted fire suppression apparatus supply piping is connected to the water supply source.

The roof-mounted fire suppression apparatus water dispersal apparatus is constructed of any durable material such as but not limited to, brass, stainless steel or other metallic material.

The roof-mounted fire suppression apparatus water dispersal apparatus is constructed using conventional technology such as, but not limited to: casting, soldering, welding or machining.

The roof-mounted fire suppression apparatus water dispersal apparatus adopts the shape of a conventional roof ridge vent and possesses a centralized threaded roof manifold conduit with a plurality of lateral conduits with dispersal nozzles on each side of the roof.

The roof-mounted fire suppression apparatus roof manifold conduit is threadingly connected to the water supply pipes.

The roof-mounted fire suppression apparatus supply plumbing is constructed of any conventional code approved piping material such as but not limited to, PVC and metal pipes.

The roof-mounted fire suppression apparatus is capable of switching remotely water supply sources in the event of water supply disruption in the public water supply due to emergency, loss of water pressure or line breakage.

The roof-mounted fire suppression apparatus possesses cisterns which are capable of collecting run-off rain water from the gutters through the return plumbing.

The roof-mounted fire suppression apparatus collects run-off rain water from the gutters via return pipes and direct this water to the cisterns for use in fire suppression.

The roof-mounted fire suppression apparatus cisterns collect and store a predetermined amount of water for the fire suppression.

The roof-mounted fire suppression apparatus cistern system utilizes common cylindrical water storage containers constructed of metal or plastic.

The roof-mounted fire suppression apparatus cisterns may be placed in any location, such as but not limited to, under or above ground and within the structure.

The roof-mounted fire suppression apparatus cisterns possess overflow plumbing to prevent water from backing up into the cistern system.

The roof-mounted fire suppression apparatus when activated discharges water through the roof manifold conduit to the lateral conduits and dispersal nozzles onto the roof structure.

The roof-mounted fire suppression apparatus when activated utilizes a pump to impel water through the supply plumbing, roof manifold conduit and dispersal nozzles.

The roof-mounted fire suppression apparatus water dispersal assemblies may be of any length and are capable of being fittingly connected to accommodate any size roof.

The roof-mounted fire suppression apparatus water dispersal assemblies are positioned and angled downwards towards the roof structure to provide for optimum water distribution.

The roof-mounted fire suppression apparatus dispersal assemblies are capable of being designed with any desired angular pitch to accommodate variously designed roof structures.

The roof-mounted fire suppression apparatus roof ridge vent acts a normal ridge vent permitting the exhaust of heated air from the structure.

The roof-mounted fire suppression apparatus roof ridge vent may be constructed of any durable material such as but not limited to metal or plastic.

The roof-mounted fire suppression apparatus water dispersal assemblies possess a plurality of dispersal nozzles which are threadingly attached to each lateral conduit.

The roof-mounted fire suppression apparatus control apparatus comprises a pump, a water valve, a control box, a control module, a flow indicating transmitter, a RF antenna, an RF receiver module, a on/off switch, and a plurality of interconnected wiring.

The roof-mounted fire suppression apparatus may be powered by any available electrical power source but in its most common application would utilize the main AC power supply of the structure.

The roof-mounted fire suppression apparatus control apparatus possesses a control module that comprises electronic circuitry, components, imbedded software and switching relays that are required to activate, control and deactivate the system.

The roof-mounted fire suppression apparatus possesses a control box to protect and house the control module, RF receiver module and interconnected wiring.

The roof-mounted fire suppression apparatus control box is comprised of a common weather-tight enclosure of durable material possessing hinges, a hasp and wall mounting capability.

The roof-mounted fire suppression apparatus when activated provides automatic fluid switching from public to cistern water supply utilizing a flow indicating transmitter which senses the low water situation and alerts the control module.

The roof-mounted fire suppression apparatus flow indicating transmitter comprises a commercially available in-line low-flow detection unit common in the industry.

The roof-mounted fire suppression apparatus possess a water valve that is a motor or solenoid powered three-way valve.

The roof-mounted fire suppression apparatus water supply valve acts to operably and selectively distribute pressurized water throughout the system.

The roof-mounted fire suppression apparatus pump is comprised of a common water transfer unit with integral electrical motor prevalent in the industry.

The roof-mounted fire suppression apparatus pump provides a pressurizing means capable of producing sufficient head pressure to propel water through the system and into the roof water dispersal assemblies.

The roof-mounted fire suppression apparatus possesses the capability of receiving a RF signal generated from a source such as but not limited to, a remote control, a cell phone or a fire station which would switch the water supply source to the system.

The roof-mounted fire suppression apparatus is capable of receiving a RF signal that may be generated through any means such as but not limited to, frequency modulation, amplitude modulation, single side band and continuous wave.

The roof-mounted fire suppression apparatus, in an alternate embodiment would connect a soffit dispersal system for protection of the side walls of a structure during a fire suppression event.

The roof-mounted fire suppression apparatus with the alternate soffit dispersal system embodiment further comprises extension and expansion of the plumbing supply lines into the soffit of the structure.

The roof-mounted fire suppression apparatus with the alternate soffit dispersal system embodiment supply lines connect to a soffit water dispersal assembly.

The roof-mounted fire suppression apparatus with the alternate soffit dispersal system embodiment possesses a soffit water dispersal assembly constructed in a similar manner to the roof water dispersal assembly.

The roof-mounted fire suppression apparatus, in the alternate soffit embodiment possesses a soffit water dispersal assembly with a plurality of lateral soffit conduit with dispersal nozzles connected and in fluid communication with the central roof manifold.

The roof-mounted fire suppression apparatus, in the alternate soffit embodiment, possesses a plurality of lateral soffit conduits that are spaced in a manner to provide optimum water coverage and maximum fire suppression effect.

The prior art appears to disclose apparatuses that provide protection to structures utilizing various types of plumbing and control arrangements. The prior art does not appear to disclose an apparatus that is capable of distributing through a roof-mounted manifold incorporated into a roof ridge vent water through lateral conduits with dispersal nozzles nor does the prior art demonstrate apparatuses that can be utilized between several water supply sources and controlled with an RF signal.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
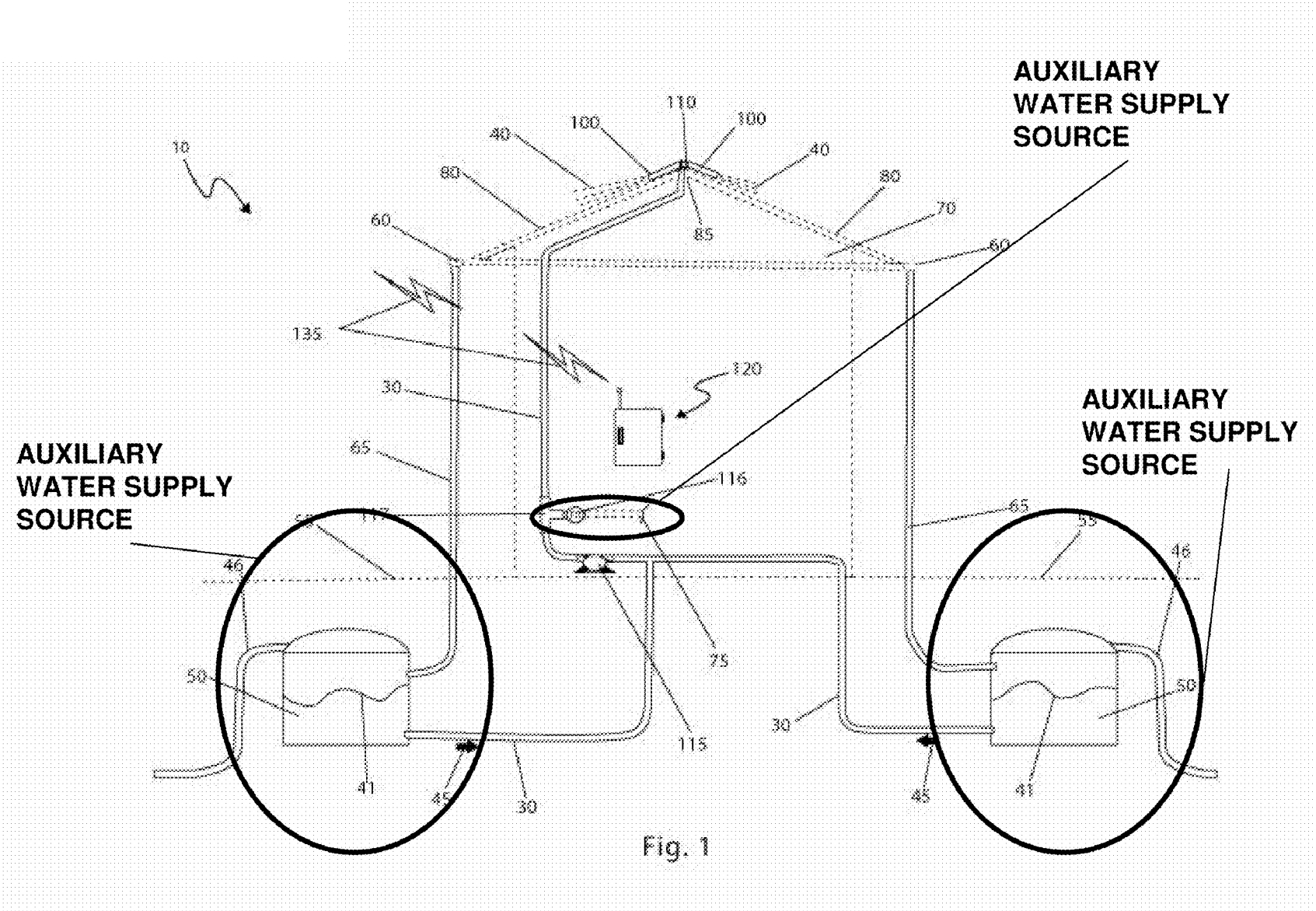
FIG. 1 is an environmental view of a roof-mounted fire suppression system 10 operably incorporated thereto a housing structure 70, according to the preferred embodiment of the present invention.

10 roof-mounted fire suppression system
30 supply plumbing
35 male threaded region
36 female threaded region
40 water
41 water level
45 water flow
46 overflow plumbing
50 cistern
55 ground
60 gutter
65 return pipe
70 housing structure
75 public water source
80 roof structure
85 apex
90 roof ridge vent
100 roof water dispersal assembly
105 roof lateral conduit
106 roof dispersing nozzle
110 roof manifold conduit
115 pump
116 flow indicating transmitter
117 water valve
120 control apparatus
121 control box
122 control box door
123 control box door hinge
124 control box door hasp
130 control module
131 radio frequency (RF) receiver module
132 RF antenna
133 interconnecting wiring
134 power cord
135 radio frequency (RF) signal
136 ON/OFF switch
140 soffit water dispersal assembly
141 soffit manifold conduit
142 soffit lateral conduit
143 soffit dispersal nozzle
144 eave/soffit

DETAILED DESCRIPTION OF THE PREFERRED EMBODIMENT

Figure 4:
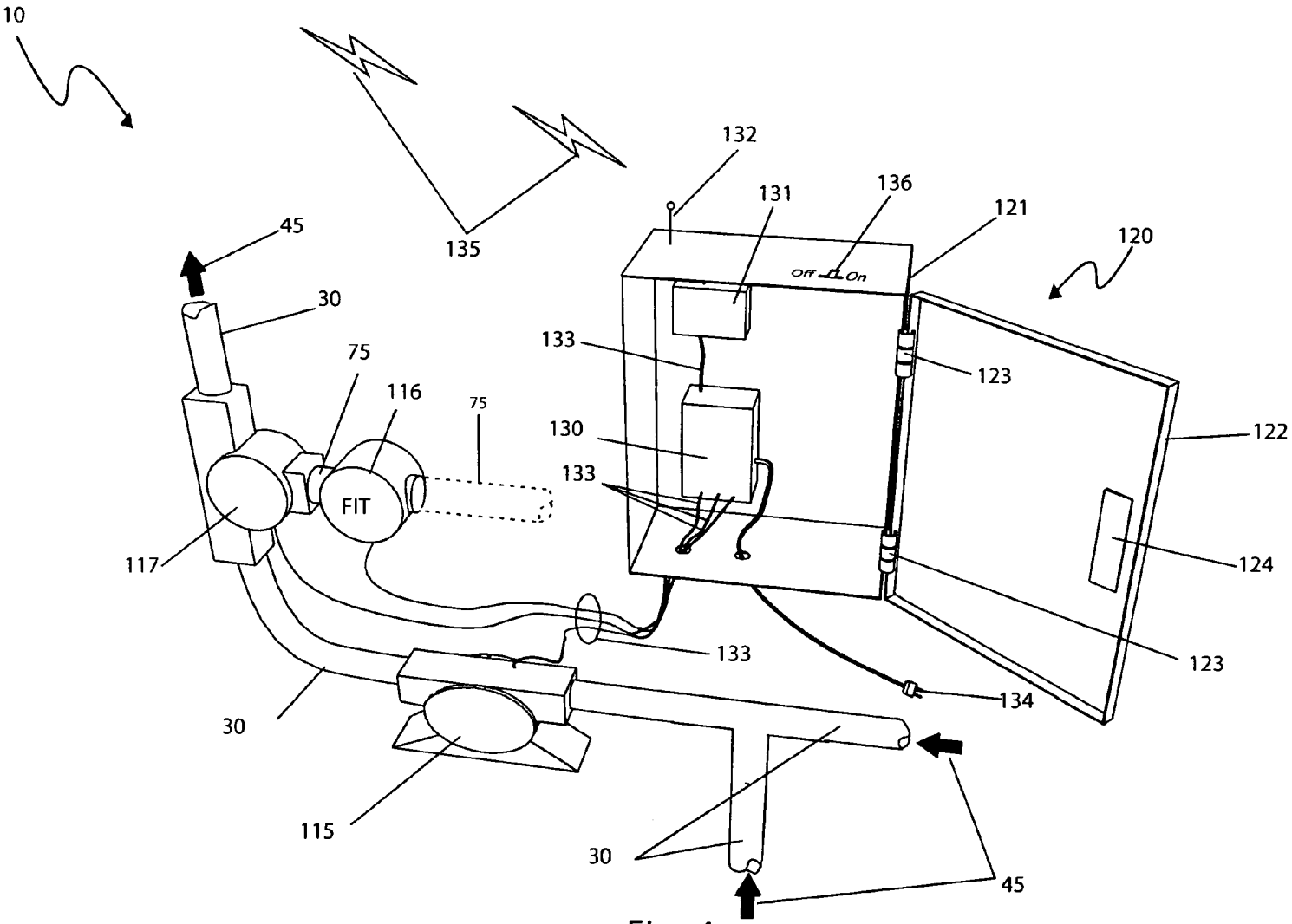
FIG. 4 is a close-up view of a control apparatus portion 120 of a roof-mounted fire suppression system 10, according to a preferred embodiment of the present invention.
Figure 5:
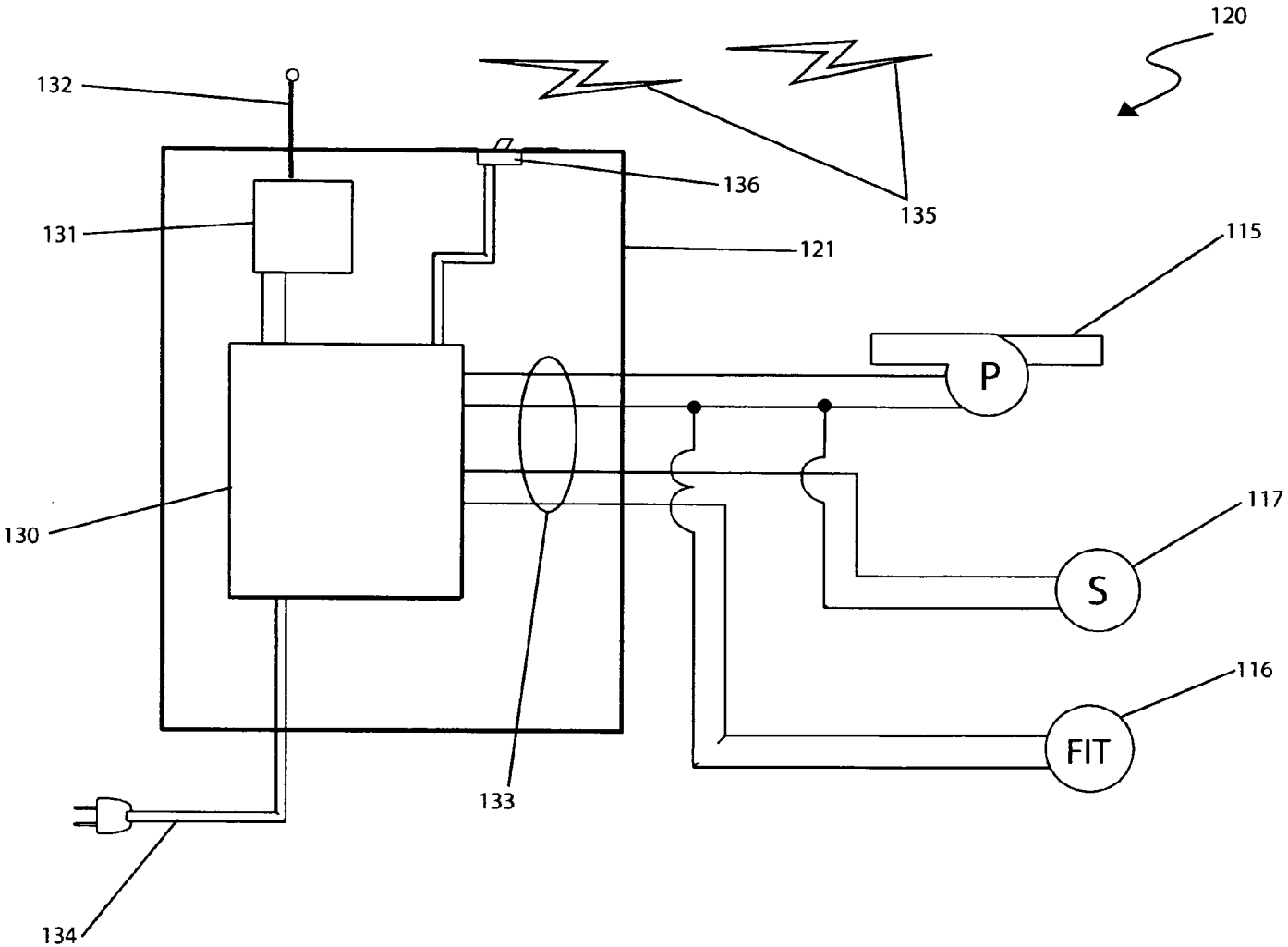
FIG. 5 is an electrical block diagram of a control apparatus portion 120 of the roof-mounted fire suppression system 10, according to a preferred embodiment of the present invention.
Figure 6A:
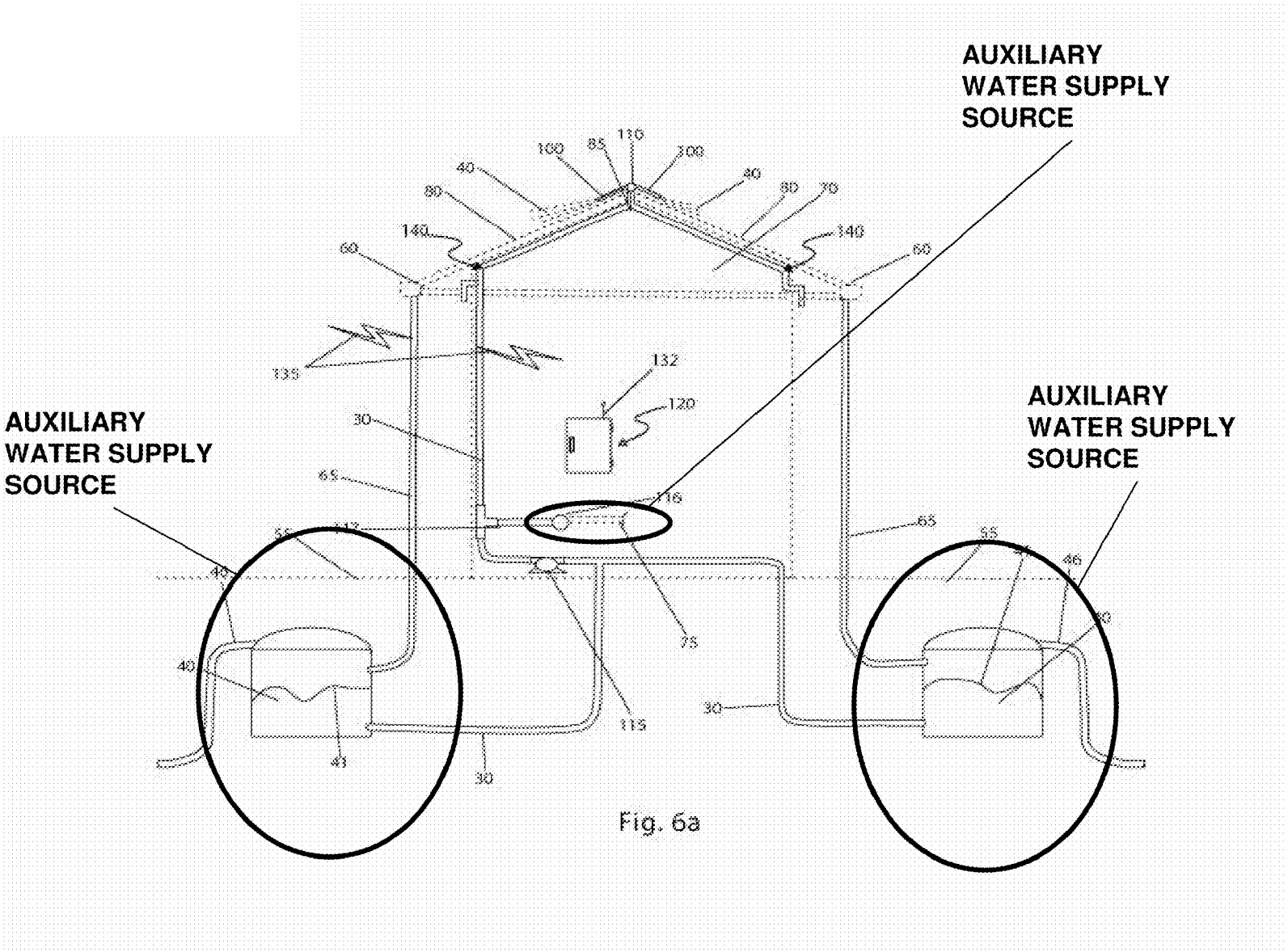
FIG. 6*a* is an environmental view of a roof-mounted fire suppression system 10 depicting an alternate soffit water dispersal assembly 140, according to an alternate embodiment of the present invention; and, FIG. 6*b* is a close-up view of a roof-mounted fire suppression system 10 depicting an alternate soffit water dispersal assembly 140, according to an alternate embodiment of the present invention.
Figure 6B:
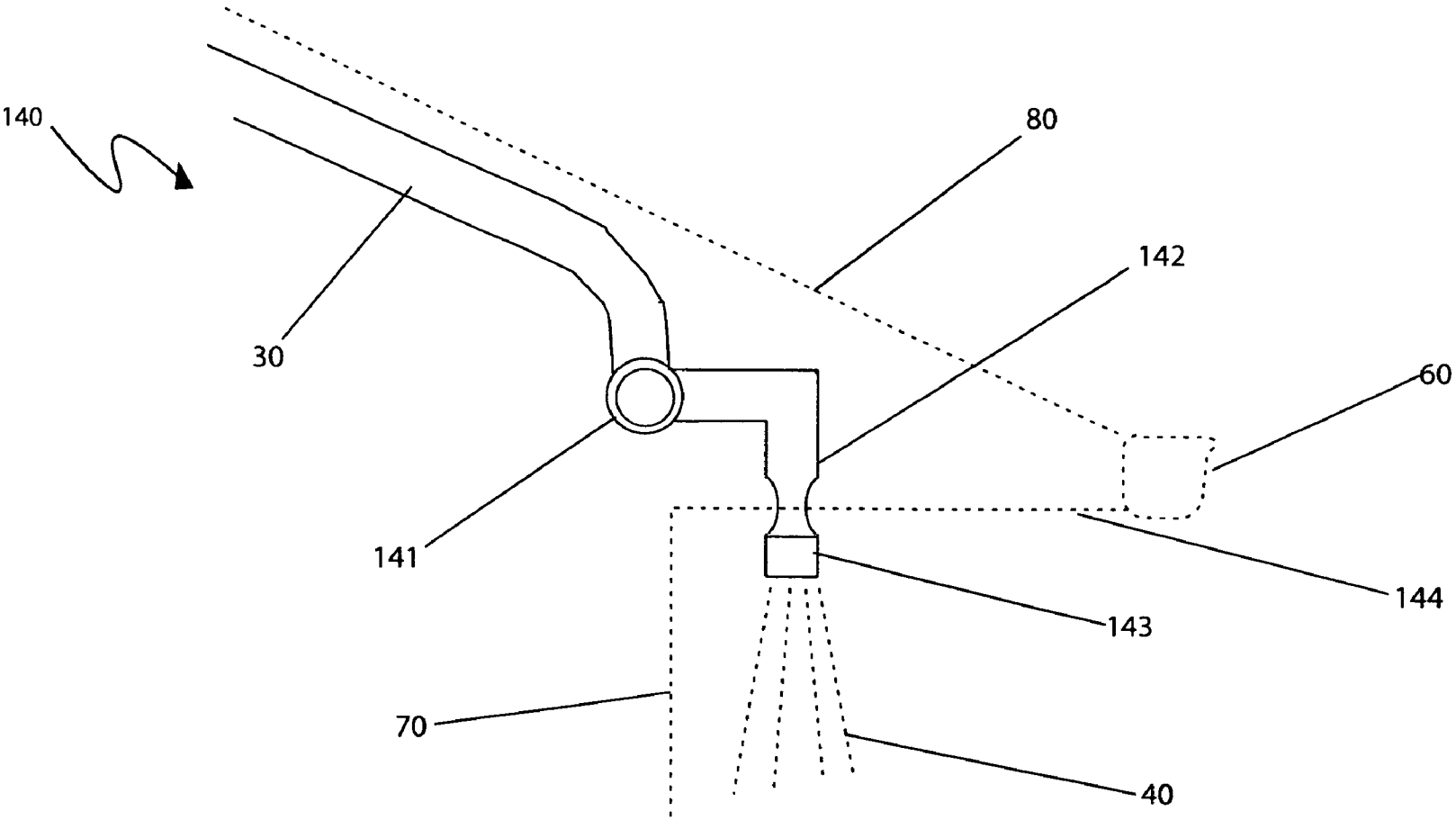

The best mode for carrying out the invention is presented in terms of its preferred embodiment, herein depicted within FIGS. 1 through 5 and in an alternate embodiment as depicted in FIGS. 6*a* and 6*b*. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a roof-mounted fire suppression system (herein described as the "system") 10, which provides a means for an external sprinkler system for use on homes 70. The system 10 is designed to prevent the ignition of a roof structure 80 from glowing ashes or embers from a nearby wild fire or structure fire. The sprinkler system 10 comprises water accumulation and pumping equipment and a plurality of roof ridge vents 100 incorporating water dispersing nozzles 106 connected to a common manifold 105 and integrated into a building structure's roof 80. The plumbing 30 connecting the manifold 105 to a water supply 75 comprises a control valve 117 and automatic controls 120 capable of remote activation and switching a water source from a normal municipal water supply 75 to a home cistern 50 in an event of lose of municipal water pressure 75. Runoff water 40 is captured by an existing gutter system 60 which collects and/or recycles water 40 through the cistern 50. During activation, the fire suppression system 10 soaks the roof 80 making it very difficult for ignition from an external source to take place.

Referring now to FIG. 1, an environmental view of the system 10 operably incorporated thereto a housing structure 70, according to the preferred embodiment of the present invention, is disclosed. The system 10 comprises a plurality of roof water dispersal assemblies 100, supply plumbing 30, a pair of cisterns 50, and a water source control apparatus 120. The water dispersal system 10 is envisioned to be made using metal materials such as, but not limited to, brass, stainless steel, or the like. However, other materials that can withstand the challenging environment of a roof structure 80 may be used in conjunction with or instead of said metallic materials.

The water dispersal system 10 would be fabricated using processes such as casting, soldering, welding, machining, or the like. The remaining components of the system 10 such as the piping 30, valves 117, cistern tanks 50, pumps 115, and the like are envisioned to be commonly available components.

Figure 2:
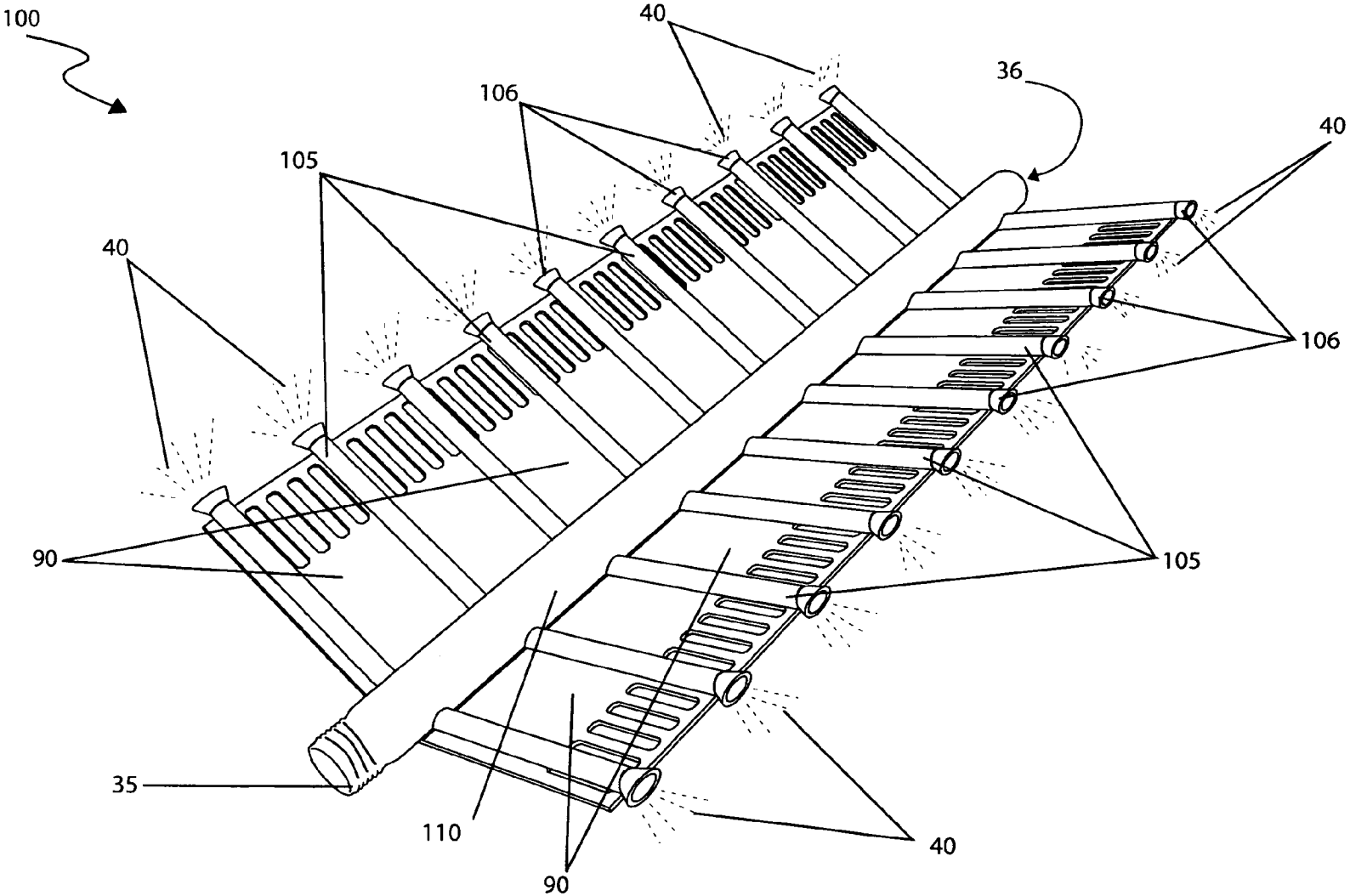
FIG. 2 is a bottom perspective view of a roof water dispersal assembly portion 100 of a roof-mounted fire suppression system 10, according to the preferred embodiment of the present invention.

The roof water dispersal assemblies 100 comprise a form and function similar thereto a conventional roof ridge vent 90; however, the roof water dispersal assemblies 100 provide additional fire-suppression functionality comprising a water spraying means therein being located at an apex 85 of a roof structure portion 80 of a housing structure 70, building, or other structure for the dispersal of pressurized water 40 (see FIG. 2). Typically, the roof structure 80 is of an "A"-frame design; however, the system 10 may be incorporated thereinto any roof apex 85 therebetween two (2) angled roof portions 80. The roof water dispersal assemblies 100 comprise a plurality of roof lateral conduits 105 positioned within the roof ridge vent portions 90 on each side of the roof structure 80 being in fluid communication therewith a roof manifold conduit 110 being threadingly coupled thereto water supply plumbing 30.

The supply plumbing 30 comprises an assembly of common vertical and horizontal metal or polyvinylchloride (PVC) pipes and fittings providing a routing means thereto said water supply 40 thereinto the housing structure 70. Said supply plumbing 30 normally utilizes water 40 obtained from a public water source 75 of the housing structure 70; however, in such a case to which a public water source 75 is no longer available thereto the housing structure 70 due to water line breaks, water 40 shutoff, or the like, a pair of cisterns 50 provides a collection and recirculation means to be utilized as a secondary water source 40. It is envisioned that a plurality of brackets, fasteners, securing hardware, and the like to be provided and utilized to fasten the supply plumbing 30, roof manifold conduits 110, and roof water dispersal assemblies 100 thereto the housing structure 70.

The cistern system 50 shown here utilizes common cylindrical water storage containers made using plastic or metal materials being adapted for positioning underground 55 in close proximity to the housing structure 70; however, it is understood that said cisterns 50 may be installed above a ground surface 55 or internal to the housing structure 70 without deviating from the basic concept and as such should not be interpreted as a limiting factor of the present invention 10. Additionally, it is understood that a water supply 40 may be accomplished alternately therefrom a well, pond, lake, or the like via common supply plumbing 30 with equal benefit. In use, the cistern 50 is adapted to contain a predetermined amount of water 40, ideally supplying said water 40 for a long period of time during a fire-suppression event.

The supply plumbing 30 extends underground thereto the housing structure 70 so that the water 40 may flow 45 from the cistern 50 thereto system 10 components located therewithin the housing structure 70. The cisterns 50 comprise overflow plumbing 46 to redirect and dispose of water 40 when an excessively high water level 41 occurs therewithin the cisterns 50.

A volume of water 40 is captured and directed thereinto said cisterns 50 via a plurality of existing gutters 60 being mounted along a peripheral edge of the roof structure 80. The gutters 60 are envisioned to comprise a screen or similar filtering covering portion thereupon, thereby removing sticks, leaves, or other forms of debris therefrom collected water 40. Said gutters 60 provide a collection means thereto rain water over a period of time being directed thereto the cisterns 50 via a plurality of return pipes 65. During a fire-suppression event, the roof water dispersal assemblies 100 discharge water 40 onto the roof structure 80, such that a water flow 45 proceeds downwardly via gravitational force into the gutters 60 for collection and recirculation within the system 10. The gutters 60 are envisioned to provide an outlet downspout means in fluid communication with a return pipe 65 for returning excess water 40 to the cistern 50. It is envisioned that baffles or similar devices may be utilized along the roof structure 80 to assist in directing collected water 40 thereto the return pipe 65.

The supply plumbing 30 provides a conduit means thereto water 40 having a proximal end in fluid communication with said cisterns 50 and a proximal end in fluid communication with a pump 115 located therewithin said housing structure 70. The pump 115 draws water therefrom a public water source 75 or alternately therefrom the cisterns 50 via the control apparatus 120 (see FIGS. 4 and 5).

The pump 115 is utilized to impel the water 40 therethrough the supply plumbing 30, roof manifold conduit 110, and thus to the roof water dispersal assemblies 100 upon activation.

Referring now to FIG. 2, a bottom perspective view of a roof water dispersal assembly portion 100 of the system 10, according to the preferred embodiment of the present invention, is disclosed. A single roof water dispersal assembly 100 is depicted here for illustration sake being approximately four (4) feet long; however, when properly installed, a plurality of roof water dispersal assemblies 100 provide an attachment means thereto one another forming a variable length linear system 10 along the apex 85 of the roof structure 80.

Each roof water dispersal assembly 100 is positioned and angled downwardly towards the roof structure 80 for an even distribution of pressurized water 40 for optimum moisture propagation. It should be noted that the roof water dispersal assemblies 100 are envisioned to be provided in a plurality of downward angles suitable for roof structures 80 having different pitches. Each roof water dispersal assembly 100 comprises a plurality of roof ridge vents 90, a central roof manifold conduit 110, a plurality of roof lateral conduits 105, and a plurality of roof dispersing nozzles 106.

The roof ridge vents 90 comprise a common exhaust means thereto heated air therewithin an interior space of the roof structure 80 in an expected manner being common in the roofing industry. The roof ridge vents 90 are envisioned being made using durable materials such as plastic, metal, or the like capable of withstanding a roof environment. The roof ridge vents 90 provide an attachment means thereto the roof lateral conduits 105 being integral and affixed thereto using adhesives, fixtures, plastic molding, plastic welding, or the like. Said roof lateral conduits 105 extend outwardly and perpendicularly therefrom a longitudinal axis of the centrally located roof manifold conduits 110. Each roof lateral conduit 105 comprises a distal end in fluid communication therewith the roof manifold conduit 110 and a proximal end in fluid communication therewith a roof dispersing nozzle 106 for dispersal of water 40 traveling therethrough. Said roof dispersing nozzles 106 comprise a threaded attachment thereto the roof lateral conduits 105 and are envisioned to comprise water directing orifices of various geometry so as to disperse the water 40 in a desired pattern and flow.

The roof manifold conduit 110 comprises one (1) or more piping elements in a horizontal configuration coupled thereto one another and affixed thereto an apex portion 85 along the length of a roof structure 80. The roof manifold conduit 110 comprises a male threaded region 35 and a female threaded region 36 at opposing ends thereof providing an attachment means enabling a user to assemble any number of roof water dispersal assemblies 100 into a desired overall length along the roof structure 80.

Figure 3:
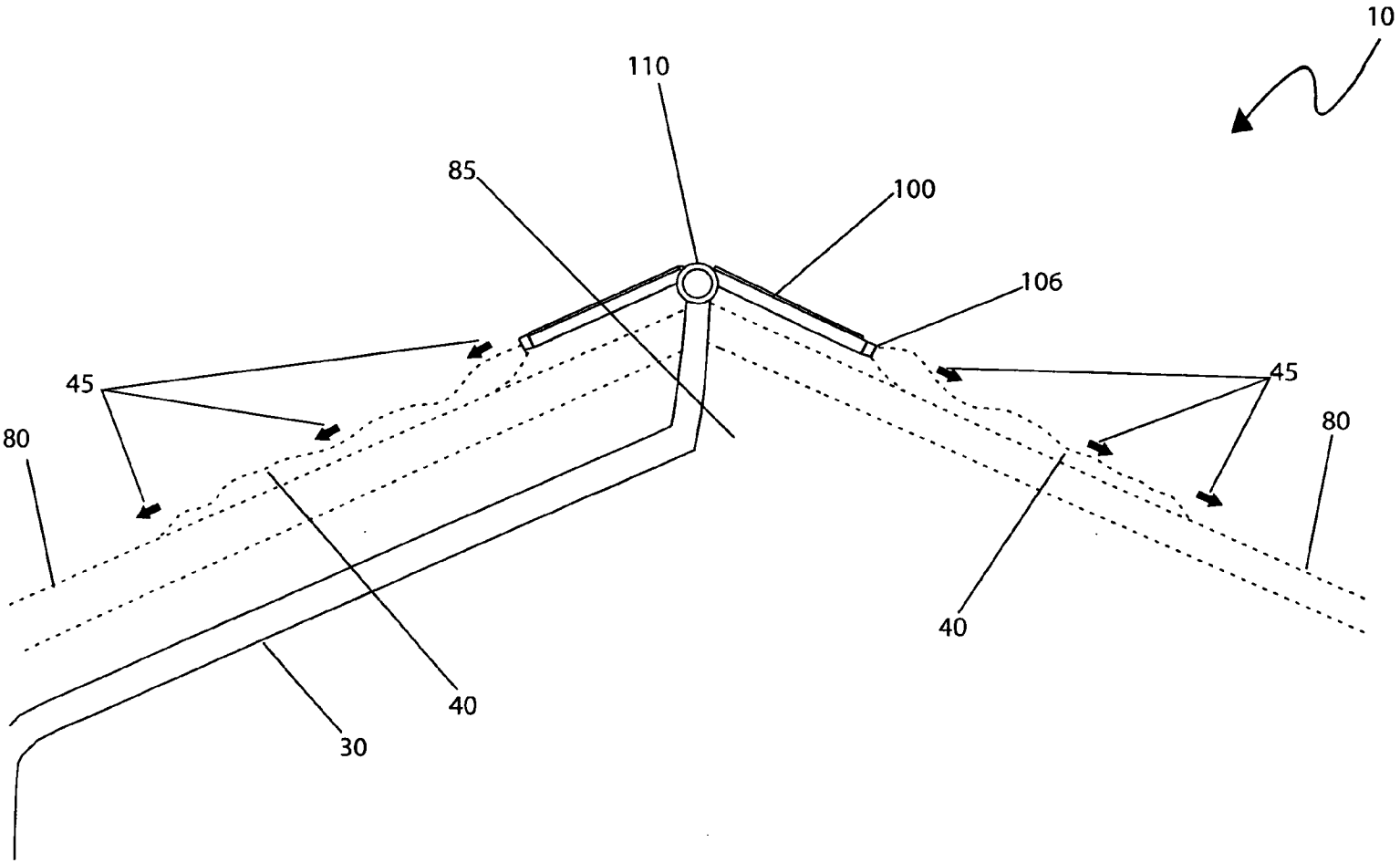
FIG. 3 is a cut-away view of a roof-mounted fire suppression system 10 installed along a roof structure portion 80, according to a preferred embodiment of the present invention.

Referring now to FIG. 3, cut-away view of the system 10 installed along a roof structure portion 80, according to the preferred embodiment of the present invention, is disclosed. The system 10 comprises a roof water dispersal assembly 100 and a water flow 45. The roof water dispersal assembly 100 as shown here, instigates an adequate water distribution 40 to convey a flow 45 of water 40 commencing therefrom the roof water dispersal assemblies 100 and roof dispersing nozzles 106. Said water dispersal assemblies 100 are mounted thereon an apex 85 portion of a roof structure 80 in fluid communication with the roof manifold conduit 110.

Referring now to FIG. 4, close-up view of a control apparatus portion 120 of a roof-mounted fire suppression system 10, according to the preferred embodiment of the present invention, is disclosed. The control apparatus portion 120 of the system 10 comprises a pump 115, a water valve 117, a control box 121, a control module 130, a flow indicating transmitter 116, an RF antenna 132, an RF receiver module 131, an ON/OFF switch 136, and a plurality of interconnecting wiring 133. Electrical power is provided thereto the control apparatus 120 via a common AC power cord 134 being inserted therein a normal 110-volt duplex outlet portion of an electrical system of the housing structure 70; however, electrical power may be obtained via a portable generator in an event in which public power is unavailable. Electrical power is in-turn distributed thereto components of the control apparatus 120 via a plurality of interconnecting wiring. Said interconnecting wiring 133 comprises common copper conductors, connectors, and the like, in an expected manner.

The control apparatus 120 provides activation of the system 10 via a manual ON/OFF switch 136. The ON/OFF switch 136 comprises a common toggle-type switching device providing a contact closure signal thereto the control module portion 130 of the control apparatus 120 located therewithin the control box 121. Said control module 130 comprises electronic circuitry, components, imbedded software, and switching relays required to activate, deactivate, and control the system 10. The control box 121 provides a protective enclosure thereto the control module 130, an RF receiver module 131, an RF antenna 132, and a plurality of interconnecting wiring 133. The control box 121 is envisioned to be a common weather-tight electrical enclosure of sufficient interior size providing expected features such as, but not limited to: an overlapping control box door 122, two (2) or more control box door hinges 123, a control box door hasp 124, and wall mounting features and fasteners.

During activation, the system 10 provides automatic fluid switching of the water supply 40 from a public water source 75 to water 40 stored within the cisterns 50. Said water supply 40 switching occurs upon receiving a low-water signal therefrom the flow indicating transmitter 116 thereto the control module 130 resulting from reduced or nonexistent water pressure from the public main water source 75. The control apparatus 120 in-turn activates the water valve 117 which selectively directs the water supply 40 thereto the roof water dispersal assemblies 100, thereby maintaining a constant water pressure 40. The flow indicating transmitter 116 comprises a commercially available in-line low-flow detection unit common in the industry. The flow indicating transmitter 116 is in electrical communication therewith the control module 130 via interconnecting wiring 133. The water valve 117 is envisioned to be a motor or solenoid powered 3-way valve to operably and selectively permit distribution of pressurized water 40 thereto the system 10.

The supply plumbing 30 provides a conduit therefrom the water supply 40 to the pump 115. The pump 115 is envisioned to be a common water transfer unit with integral electric motor common in the industry. The pump 115 provides a pressurizing means capable of producing sufficient head pressure to propel said water 40 thereto the roof water dispersal assemblies 100.

In addition to the aforementioned manual activation of the system 10 using the ON/OFF switch 136, the control apparatus 120 further comprises an RF receiver module 131 which provides a remote actuation means thereto the system 10 via a received RF signal 135 generated therefrom remote sources such as a cell phone, a fire station, or the like. The RF receiver module 131 receives said RF signal 135 via an RF antenna 132 being stationarily mounted thereto an upper surface of the control box 121. The RF receiver module 131 in-turn conducts a signal voltage thereto the control module 130, thereby activating the system 10 from a remote location.

Referring now to FIG. 5, an electrical block diagram of the control apparatus 120, according to the preferred embodiment of the present invention, is disclosed. Electrical power is provided thereto the control apparatus 120 via a common AC power cord 134 being inserted therein a normal 110-volt duplex outlet portion of an electrical system of the housing structure 70. Electrical power is in-turn distributed thereto a control module 130, an RF receiver module 131, and an ON/OFF switch 136 via interconnecting wiring 133 housed within a control box 121. The control module 130 receives input signals therefrom the ON/OFF switch 136 and the RF receiver module 131 to activate/deactivate the system 10 locally and from a remote location via an RF signal 135, respectively. The RF signal 135 comprises a one-way signal and does not provide for duplex communication or confirmation of a received RF signal 135. It is envisioned that the RF signal 135 would be of a frequency modulated (FM) signal on a frequency authorized for such use; however, other methods of modulation such as amplitude modulation, single side band, digital, continuous wave and the like would work equally well, and as such, should not be interpreted as a limiting factor of the invention 10. Said control module 130 comprises electronic circuitry, components, imbedded software, and switching relays required to activate, deactivate, and operate the system 10. During activation of the system 10 the flow indicating transmitter 116 provides an automatic low-flow detection means thereto the control apparatus 120. During operation of the control apparatus 120 output voltage is provided thereto the pump 115 and the water valve 117, thereby propelling pressurized water 40 through the system 10.

Referring to FIGS. 6*a* and 6*b*, environmental and close-up views of a roof-mounted fire suppression system 10 depicting an alternate soffit water dispersal assembly 140, according to an alternate embodiment of the present invention, are disclosed. The alternate soffit water dispersal assembly 140 shown here comprises a soffit manifold conduit 141, a plurality of soffit lateral conduits 142, and a plurality of soffit dispersal nozzles 143. The soffit water dispersal assembly 140 provides an additional fire-suppression means thereto exterior side walls of the housing structure 70 envisioned to be used in conjunction with the preferred roof water dispersal assembly embodiment 100, thereby providing a moisture protection thereto all outer surfaces of said housing structure 70. The soffit water dispersal assembly 140 comprises joint use of a water supply 40 together with the aforementioned preferred roof water dispersal assemblies 100. The soffit water dispersal assembly 140 further comprises extension and expansion of the supply plumbing 30 thereto an eave/soffit portion 144 along a perimeter of a housing structure 70. The supply plumbing 30 is in fluid communication therewith the soffit manifold conduit portion 141 of the alternate soffit water dispersal assembly 140 which is routed in a parallel manner to and within said eave/soffit space 144 in a similar manner as the roof manifold conduit 110. A plurality of equally-spaced soffit lateral conduits 142 are in fluid communication thereto said roof manifold conduit 110 in similar fashion as the previously described roof lateral conduits 105 being formed and extending vertically and/or horizontally therefrom, so as to penetrate said eave/soffit panels 144 vertically, thereby being exposed and deployed along a lower external surface of said eave/soffit 144. Each soffit lateral conduit 142 comprises a soffit dispersal nozzle 143 being threadingly attached thereto a lower end portion. The soffit dispersal nozzles 143 are envisioned to be similar in construction, materials, and function as the roof dispersing nozzles 106 (see FIG. 2), thereby spraying a protective covering of water 40 thereupon exterior wall portions of the housing structure 70. The soffit lateral conduits 142 are envisioned to be spaced and directed along said eave/soffit 144 so as to provide complete moisture coverage of said water supply 40 therefrom said soffit dispersal nozzles 143 envisioned to be spaced approximately every one (1) to two (2) feet so as to produce a uniform coating of water 40 thereupon said wall surfaces of the housing structure 70.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. Installation of the system 10 is envisioned to be accomplished by trained professional craftsmen. After initial purchase or acquisition of the system 10, it would be installed as indicated in FIG. 1 and as indicated in the alternate embodiment shown in FIG. 6*a*.

The method of installing and utilizing the preferred embodiment of the system 10 may be achieved by performing the following steps: installing the system 10 thereto an existing public water system 75 within a housing structure 70 using the supply plumbing 30; connecting the system 10 thereto the cistern system 50 using the supply plumbing 30; integrating the water valve 117, the pump 115, and the flow indicating transmitter 116 into the supply plumbing 30; routing the supply plumbing 30 thereto an apex portion 85 of the roof structure 80 along interior walls; installing and threadingly joining any number of roof water dispersal assemblies 100 along an apex portion 85 of a roof structure 80 as required using provided fasteners; installing remaining required roofing materials to compete a protective roofing project thereto the housing structure 70; attaching the control box 121 thereto an interior wall of the housing structure 70 in proximity thereto the water valve 117, pump 115, and flow indicating transmitter 116; routing interconnecting wiring 133 between said components of the control apparatus 120 using the interconnecting wiring 133; collecting rain water into the cisterns 50 over a period of time; activating the system 10 locally using the ON/OFF switch 136 or remotely using an RF signal 135 being transmitted therefrom a cell phone or a fire station being received by the RF antenna 132; automatically sensing low or non-existent water pressure therefrom the public water source 75 using the flow indicating transmitter 116; switching from the public water source 75 thereto the water 40 stored in the cisterns 50 using the water valve 117; propelling the water supply 40 thereto the roof water dispersal assemblies 100 to provide a water flow 45 upon a roof structure 80 to suppress possible air-borne ignition sources such as glowing ashes or embers from a nearby wild fire or structure fire; deactivating the system 10 after a threat of fire passes using the ON/OFF switch 136 or an RF signal 135 transmitted therefrom a cell phone or a fire station; and, benefiting from increased protection of one's housing structure 70 using the present invention 10.

The method of installing and utilizing the alternate soffit water dispersal assembly embodiment 140 of the system 10 may be achieved by performing the following additional steps: expanding the supply plumbing system 30 along eave/soffits 144 as required within the housing structure 70; installing the soffit manifold conduit 141 and soffit lateral conduits 142 along said eave/soffit areas 144; vertically penetrating the eave/soffits 144 using the soffit lateral conduits 142 and soffit dispersal nozzles 143; and, providing a protective water flow 45 thereto outer vertical wall surfaces along a perimeter of a housing structure 70 upon activation of the system 10.

The system 10 is envisioned to be adapted for use in association with an existing housing structure 70 or other free-standing structures such as, but not limited to, office buildings, apartment complexes, and others.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A roof-mounted fire suppression system for preventing thermal ignition of a building structure from a nearby external fire, said roof-mounted fire suppression system comprising:

a plurality of water dispersal assemblies disposed along said building structure and adjacent to an apex thereof, each further comprising:

a plurality of ridge vents;

a manifold conduit coupled to said ridge vents and being provided with axially opposed male and female threaded ends;

a plurality of lateral conduits coupled to said ridge vents; and, a plurality of dispersing nozzles coupled to said lateral conduits;

wherein said lateral conduits extend outwardly and perpendicularly from a longitudinal axis of said manifold conduit;

an auxiliary water supply source for directing water towards said building structure, said water dispersal assemblies being simultaneously coupled to an existing main water supply source and said auxiliary water supply source respectively;

means for remotely activating and switching between said main and said auxiliary water supply sources when a main water pressure level decreases, further comprising:

a plurality of water supply plumbing conduits in fluid communication with said water dispersal assemblies; and, a water source control apparatus operably connected to said water supply plumbing conduits, comprising:

a control box;

a control module seated within said control box;

a water valve electrically coupled to said control module;

a flow indicating transmitter electrically coupled to said control module;

a pump connected to said water supply plumbing and being electrically connected to said water source control apparatus;

a receiver electrically coupled to said control module; and, an operating switch electrically coupled to said control module;

wherein said flow indicating transmitter generates and transmits a low water pressure level signal to said control module when detecting a drop in said main water pressure level from said main water supply source, said control module generating and transmitting a control signal to said control valve upon receipt of said low water pressure level signal; and, means for capturing runoff water along said building structure such that said runoff water is collected and recycled through said auxiliary water supply source.

2. The roof-mounted fire suppression system of claim 1, further comprising: an auxiliary soffit water dispersal assembly for soaking all outer surfaces of the building structure and comprising:

a soffit manifold conduit in fluid communication with at least one of said water supply plumbing conduits, said soffit manifold conduit including a soffit portion extending along a perimeter of the building structure;

a plurality of lateral soffit conduits, and, a plurality of soffit dispersal nozzles;

wherein said water supply plumbing conduits are in fluid communication with said soffit manifold conduit, said lateral soffit conduits being spaced along existing soffit panels of the building structure and vertically penetrate therethrough to expose said soffit dispersal nozzles along a lower external surface of the soffit.

3. A roof-mounted fire suppression system for preventing thermal ignition of a building structure from a nearby external fire, said roof-mounted fire suppression system comprising:

a plurality of water dispersal assemblies disposed along said building structure and along a top roofline thereof, each further comprising:

a plurality of ridge vents;

a manifold conduit coupled to said ridge vents and being provided with axially opposed male and female threaded ends;

a plurality of lateral conduits coupled to said ridge vents; and, a plurality of dispersing nozzles coupled to said lateral conduits;

wherein said lateral conduits extend outwardly and perpendicularly from a longitudinal axis of said manifold conduit;

an auxiliary water supply source for directing water towards said building structure, said water dispersal assemblies being simultaneously coupled to an existing main water supply source and said auxiliary water supply source respectively, said auxiliary water supply source comprising a cistern;

means for remotely activating and switching between said main and said auxiliary water supply sources when a main water pressure level decreases, further comprising:

a plurality of water supply plumbing conduits in fluid communication with said water dispersal assemblies; and, a water source control apparatus operably connected to said water supply plumbing conduits, comprising:

a control box;

a control module seated within said control box, a water valve electrically coupled to said control module;

a flow indicating transmitter electrically coupled to said control module;

a pump connected to said water supply plumbing and being electrically connected to said water source control apparatus;

a receiver electrically coupled to said control module; and, an operating switch electrically coupled to said control module;

wherein said flow indicating transmitter generates and transmits a low water pressure level signal to said control module when detecting a drop in said main water pressure level from said main water supply source, said control module generating and transmitting a control signal to said control valve upon receipt of said low water pressure level signal; and, means for capturing runoff water along said building structure such that said runoff water is collected and recycled through said auxiliary water supply source.

4. The roof-mounted fire suppression system of claim 3, further comprising: an auxiliary soffit water dispersal assembly for soaking all outer surfaces of the building structure and comprising:

a soffit manifold conduit in fluid communication with at least one of said water supply plumbing conduits, said soffit manifold conduit including a soffit portion extending along a perimeter of the building structure;

a plurality of lateral soffit conduits, and, a plurality of soffit dispersal nozzles;

wherein said water supply plumbing conduits are in fluid communication with said soffit manifold conduit, said lateral soffit conduits being spaced along existing soffit panels of the building structure and vertically penetrate therethrough to expose said soffit dispersal nozzles along a lower external surface of the soffit.

* * * * *